US007481684B2

(12) United States Patent
Bundren

(10) Patent No.: US 7,481,684 B2
(45) **Date of Patent: *Jan. 27, 2009**

(54) Z-SHAPED TRANSFORMER BAR ELECTRICAL CONNECTOR

(75) Inventor: Jason L. Bundren, Leeds, AL (US)

(73) Assignee: Hubbell Incorporated, Orange, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/007,806

(22) Filed: Jan. 15, 2008

(65) Prior Publication Data

US 2008/0146089 A1 Jun. 19, 2008

Related U.S. Application Data

(63) Continuation-in-part of application No. 11/812,726, filed on Jun. 21, 2007, now Pat. No. 7,416,454, which is a continuation-in-part of application No. 11/332,479, filed on Jan. 17, 2006, now Pat. No. 7,175,484, and a continuation of application No. 11/637,189, filed on Dec. 12, 2006, now abandoned.

(51) Int. Cl.
*H01R 11/09* (2006.01)

(52) U.S. Cl. ..... 439/798; 439/907

(58) Field of Classification Search ..... 439/775, 439/796, 797, 798, 806, 907, 921
See application file for complete search history.

(56) References Cited

U.S. PATENT DOCUMENTS

| | | | |
|---|---|---|---|
| D118,588 | S | 1/1940 | Blackburn |
| 2,887,669 | A | 5/1959 | Sylvester |
| 3,133,779 | A | 5/1964 | Stanback |
| 3,766,810 | A | 10/1973 | Romak |
| 3,794,963 | A | 2/1974 | Cooper, Jr. |
| 4,214,806 | A | 7/1980 | Kraft |
| D302,420 | S | 7/1989 | McGrane |
| D309,664 | S | 7/1990 | McGrane |
| D320,381 | S | 10/1991 | McGrane |
| 5,586,905 | A | 12/1996 | Marshall et al. |
| 5,690,516 | A | 11/1997 | Fillinger |
| 5,692,930 | A | 12/1997 | Garver et al. |
| 6,325,677 | B1 | 12/2001 | Tamm |
| 6,347,967 | B1 | 2/2002 | Tamm |
| 6,579,131 | B1 | 6/2003 | Ashcraft et al. |

(Continued)

*Primary Examiner*—Thanh-Tam T Le
(74) *Attorney, Agent, or Firm*—Jenae C. Gureff; Mark S. Bicks; Alfred N. Goodman

(57) ABSTRACT

An electrical connector for clamping securely onto a threaded shaft, comprising a transformer bar, a connector body, and a clamping component. The transformer bar includes a plurality of conductor bores therein, a distal end, an upper component having at least one setscrew extendable into one of the bores with wrenching on an exposed end thereof, and a lower component with a lower end surface remote from the exposed end of the setscrew. The transformer bar is substantially Z-shaped such that a bottom end of the upper component is adjacent a top end of the lower component. The connector body at the distal end includes at least one boss adjacent the lower surface of the lower component. The connector body also includes first and second connector sides. The clamping component is pivotally mounted by an attachment link to the boss to be selectively located adjacent each of the first and second connector sides.

20 Claims, 2 Drawing Sheets

U.S. PATENT DOCUMENTS 6,769,941 B2 8/2004 Norden
6,939,183 B2 9/2005 Ferretti et al.
7,014,514 B2 3/2006 Zahnen
7,052,333 B2 * 5/2006 Siracki et al. ..... 439/798
7,175,484 B1 2/2007 Tamm et al.
2004/0067697 A1 4/2004 Zahnen
2007/0026745 A1 2/2007 Ferretti

* cited by examiner

Z-SHAPED TRANSFORMER BAR ELECTRICAL CONNECTOR

CROSS REFERENCE TO RELATED APPLICATIONS

This application claims the benefit of and is a continuation-in-part of U.S. patent Ser. No. 11/812,726, filed Jun. 21, 2007,now U.S. Pat No. 7,416,454 which claims the benefit and is a continuation-in-part of U.S. patent Ser. No. 11/332,479, filed Jan. 17, 2006 now U.S. Pat. No. 7,175,484 and a continuation of U.S. patent Ser. No. 11/637,189, filed Dec. 12, 2006 now abandoned. Those applications are hereby incorporated by reference in their entireties.

FIELD OF THE INVENTION

The present invention relates to an electrical connector for clamping securely onto a threaded shaft. The connector includes a substantially Z-shaped transformer bar, a connector body, and a clamping component. More particularly, the transformer bar includes a plurality of conductor bores therein, a distal end, an upper component, and a lower component. A bottom end of the upper component is adjacent a top end of the lower component to form the Z-shape. The connector body at the distal end includes at least one boss adjacent the lower component. The connector body also includes first and second connector sides. The clamping component is pivotally mounted by an attachment link to the boss to be selectively located adjacent each of the first and second connector sides.

BACKGROUND OF THE INVENTION

Conventional electrical connectors are known for connecting the studs of transformers to wires. A transformer includes an output conductor in the form of a threaded stud which may be connected to a plurality of individual electrical conductors by a transformer stud connector. The most common methods employed for the application of making electrical connections to transformer bushing studs include: (a) screw on, (b) split screw on, (c) slip fit, (d) modified slip fit providing a saddle or nest for the threaded stud, (e) modified slip fit to accommodate two stud sizes, and (f) clamp on. All of these methods can be or have been improved.

The screw on connection relies on a jam nut to maintain a tight interface. Movement of the attached conductors promote slight amounts of torque which cause the screw on bushing stud to loosen, heat up, and eventually fail. Oftentimes, a plurality of conductors is attached to an individual stud. If failure occurs at the electrical interface of the connector or an internal fault in the transformer, all of these conductors must be removed from their respective attachment points to the stud connector. The device is rotated many times to remove it from the stud because it is threaded.

The split screw on connection evolved as a recognition of the loosening of the threaded interface. It provides a split down one side of the threaded connector and a provision for a bolt, or plurality of bolts along this split. When the connector is screwed into place, the bolts are tightened, cinching the connector about the periphery of the stud as opposed to utilizing a jam nut to maintain the secure integrity of the electrical interface. The problem of having to disconnect a plurality of conductors for the purpose of removing the connector is still prevalent.

U.S. Pat. No. 4,214,806 to Kraft discloses a slip fit connection with an internally threaded bore. The inside diameter of the bore is greater than the diameter of the crest of the threaded stud, and having an identical pitch. This connector is slipped over the threaded stud without requiring rotation. Once positioned over the stud, a set screw drives the connector into an eccentric relationship with the stud, causing the threads of equal pitch to nest with one another along the side of the inner bore. This causes a problem with the secure integrity of the electrical interface because the relationship between the stud and the bore of the connector provides only a single line interface.

The fourth type, a modified slip fit device with a saddle or nest for the threaded stud, is disclosed, e.g., in U.S. Pat. No. 5,690,516 to Fillinger. This provides a stepped stud hole having an oversize unthreaded circular hole on top and a slightly smaller intersecting hole on the bottom which provides a mating thread profile and is dimensioned to that of the stud for which it is sized. This structure improves the electrical connection by improving the integrity of the mechanical connection and providing a greater surface area for electrical interface. However, as is well known in the field of mechanical connections of a clamp design, some element of resiliency is required to provide the clamping force. The most prominent example is the elongation of bolt under tensile stress. This tensile stress, when limited within the elastic range of the material, compensates for slight dimensional changes in the bolted joint resulting from thermal changes, maintaining the integrity of the joint.

This resilient clamping force or stored mechanical energy is especially important with electrical connections, since the temperature of electrical connections varies with changes in current. The setscrew or compression screw utilized in the slip fit connectors does not offer the degree of elastic range in the joint as a bolt under tension. These connectors are predominantly aluminum, while the transformer stud bushings are copper. These two materials have differing coefficients of thermal expansion, with the aluminum expanding at a magnitude of approximately 1½ times the rate of copper for a given increase in temperature. In operation, these connectors typically operate at a thermal rise of as much as 75° C. over ambient. The connector, being aluminum, expands at a rate greater than that of the copper stud. Not having a resilient clamping force, or stored mechanical energy in the connection, the electrical interface becomes loose, resulting in increased resistance to the joint, which results in increased temperature rise.

With the advent of a compound bar design, as taught by the U.S. Design Pat. No. 309,664 to McGrane, a provision is made for two stud receiving bores of different sizes. The two most common thread sizes of transformer bushing studs in the United States are 5/8-11 UNC and 1-14 UNS. Both sizes are in common use, depending on the size of the transformer, and it is advantageous to have a connector which accommodates either size.

The modified slip fit to accommodate two stud sizes is taught by U.S. Pat. No. 6,579,131 to Ashcraft, providing two threaded nests offset from an original slip fit bore similar to the above described modified slip fit. This design illustrates the need for securely mounting a single connector on two different transformer bushing stud sizes, yet the same problem of not providing a resilient clamping force as described above is not provided.

The clamp disclosed in U.S. Pat. No. 6,347,967 to Tamm discloses a stored mechanical energy type electrical connector. This aluminum connector is coupled onto a solid copper stud. The stud has no resiliency to provide to the connection as does a strand conductor. The greater differential of the coefficient of thermal expansion of the aluminum causes such connection to become loose as temperature increases, if it does not have the benefit of stored mechanical energy to offset thermal expansion of the aluminum.

The Tamm electrical connection can accommodate only a single stud size, and therefore, lacks the versatility needed in the present market. Further, the components of this device are not captive, resulting in the propensity of the installer to drop or lose one or more components, particularly the bolt or nut, during installation. The hazards of such loose hardware are readily apparent in an electrical enclosure.

The clamp disclosed in U.S. patent Ser. No. 11/332,479 to Tamm accommodates a transformer bar having streetlight tap wires towards its end opposite the connector component. This presents a difficult configuration for supplementing the transformer bar with streetlight taps and a redundant ground in close proximity to a stud terminal.

Accordingly, a need exists for providing a unique and improved electrical connector for attaching a clamping component to the stud terminal of an electrical device, such as is common on transformer bushings, and for providing an attachment to two different sizes of studs.

SUMMARY OF THE INVENTION

Accordingly, an object of the present invention is to provide an electrical connector having a substantially Z-shaped transformer bar with a plurality of conductor bores.

Another object is to provide a transformer connector having an upper component and a lower component oriented such that a lower corner of the upper component is adjacent an upper corner of the lower component.

A further object is to provide a Z-shaped electrical connector having a superior clamping force and a high integrity electrical connection to bushing studs.

Yet another object is to provide a transformer connector having a plurality of main conductor bores disposed below setscrew bores arranged in upper and lower compartments.

Still another object is to provide a connector body with an attachment link coupled to one end for rotating a clamping component around the connector body to support more than one sized electrical stud where the clamping component and connector body are attached towards the bottom of the transformer.

The foregoing objects are basically attained by providing an electrical connector comprising a transformer bar, a connector body, and a clamping component. The transformer bar has a plurality of conductor bores therein, a distal end, and an upper component having at least one setscrew extendable into one of the bores with wrenching on an exposed end thereof, and a lower component with a lower end surface remote from the exposed end of the setscrew. The upper and lower components are substantially Z-shaped such that a bottom end of the upper component is adjacent a top end of the lower component. The connector body at the distal end includes at least one boss adjacent the lower surface of the lower component. The connector body also includes first and second connector sides. The clamping component is pivotally mounted by an attachment link to the boss to be selectively located adjacent each of the first and second connector sides.

The foregoing objects are also attained by providing an electrical connector comprising a transformer bar having a plurality of conductor bores therein, a distal end, an upper component, and a lower component offset from the upper component such that a lower corner of the upper component is coupled to an upper corner of the bottom component. The connector body at the distal end includes a boss at the lower component having first and second connector sides. A clamping component is pivotally mounted by an attachment link to the boss to be selectively located adjacent each of the first and second connector sides. A uniformly sized stud is adjacent a clamping component for accommodating attachment to one of a first and second side of the bar.

As used in this application, the terms "top", "bottom", and "side" are intended to facilitate the description of the bar electrical connector, and are not intended to limit the description of the electrical connector to any particular orientation.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

Throughout the drawings, like reference numerals will be understood to refer to like parts, components, and structures.

DETAILED DESCRIPTION OF THE INVENTION

Figure 1:
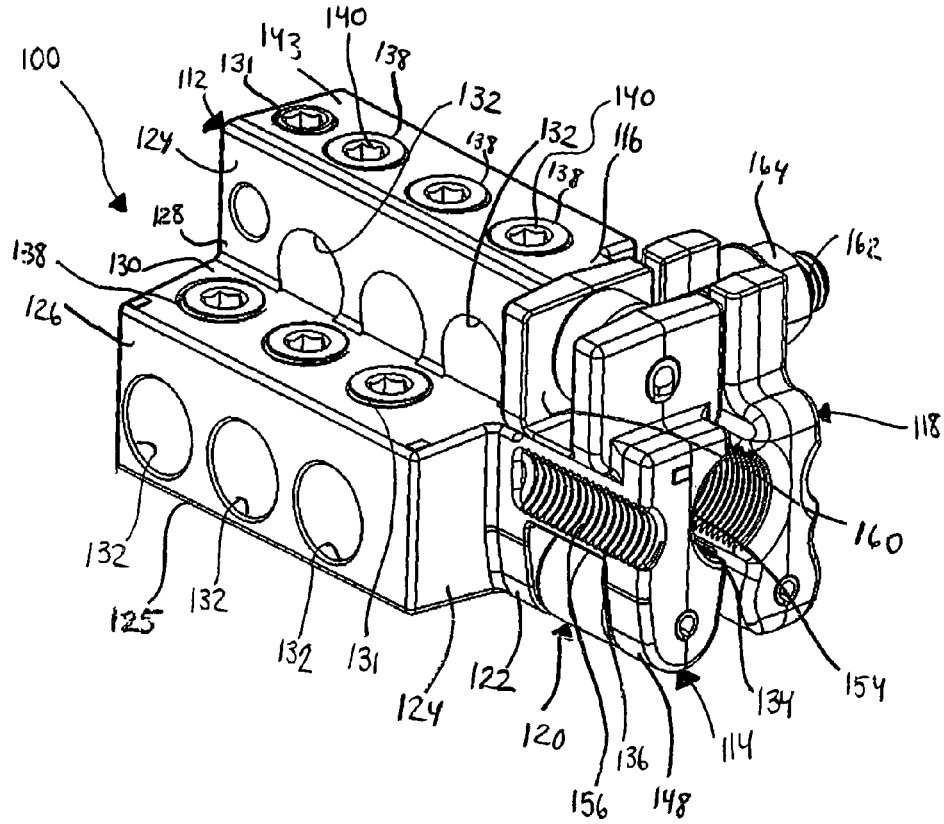
FIG. 1 is a rear, perspective view of the electrical connector, showing the flange nut tightened and the connector in a closed position as if having already received a stud of a larger size according to an embodiment of the present invention.

Turning to FIGS. 1-4, an electrical connector 100 comprises a multi-tiered transformer bar 112, a connector body 114 at a distal end 116 of the transformer bar 112, and a clamping component 118 pivotally mounted by an attachment link 120 to a boss 122 attached at the bottom end 124 of the transformer bar 112.

Referring to FIG. 1, the connector 100 is illustrated in its closed position. The elongated portion of the electrical connector 100 comprises the transformer bar 112. The transformer bar 112 is multi-tiered and substantially Z-shaped such that it includes an upper component 124 and a lower component 126 having an orientation defined by a bottom corner 128 of the upper component 124 being coupled to an upper corner 130 of the lower component 126.

The transformer bar 112 includes a plurality of conductor bores 132 extending transversely therethrough for receiving branch circuit wires. The conductor bores 132 are arranged in a row along the upper component 124 and in a parallel row along the lower component 126. This configuration allows multiple branch circuit wires to be connected to the transformer bar 112 without compromising the shape of the electrical connector 100. Although FIG. 1 illustrates six main cable bores 132, additional or fewer bores could be provided by lengthening or shortening the transformer bar 112.

The transformer bar 112 further comprises a plurality of setscrew bores 138 arranged in a row above and oriented transverse to the conductor bores 132, similarly along the upper component 124 and lower component 126. Each setscrew bore 138 is internally threaded to receive a setscrew 140 extendable into one of the bores with wrenching on an exposed end 131 of the upper component 124 for clamping down on a respective branch circuit wire inserted into each bore 132. The lower component 126 further includes a lower end surface 125 remote from the exposed end 131 of the setscrew 140. This arrangement retains the branch circuit wires in the transformer bar 112 and prevents them from becoming dislodged. Each conductor bore 132 corresponds to a different and respective setscrew bore 138 such that each setscrew bore 138 is oriented perpendicularly to each conductor bore 132. Each setscrew 140 is oriented along the upper component 124 such that the swing bolt 162 is adjacent the upper component 124 setscrew 140. Given this configuration, the first and second bosses 122, 148 of the connector body 114 are adjacent the lowermost position of the lower component 126.

Figure 2:
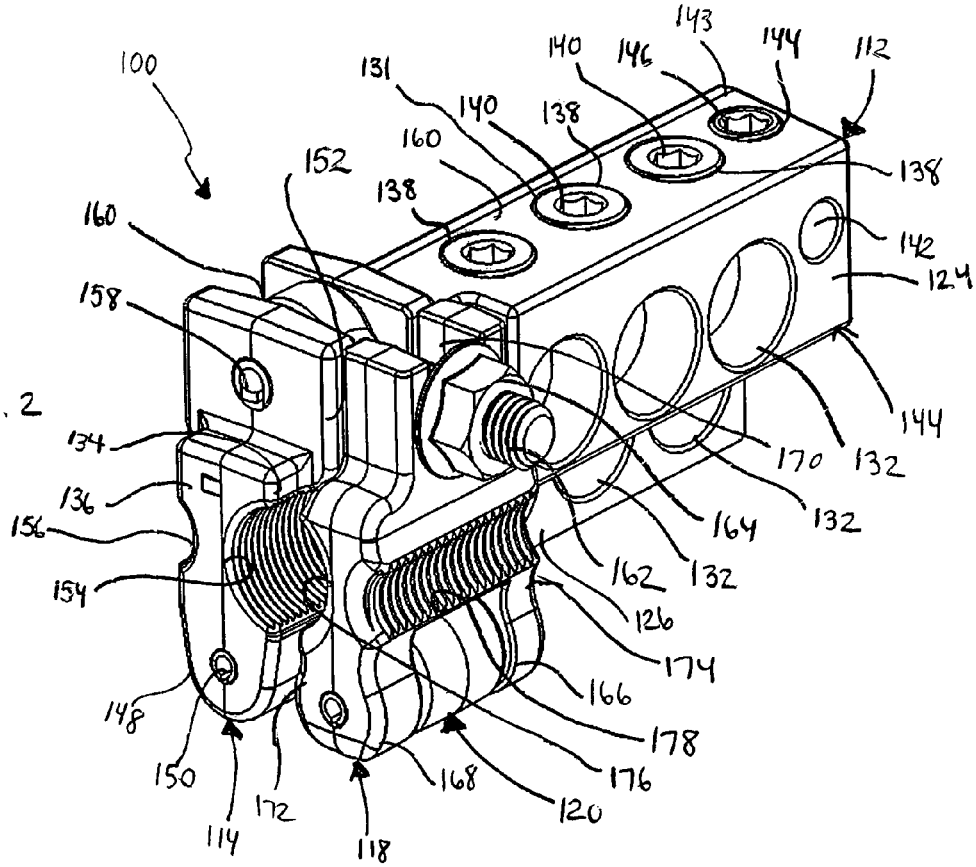
FIG. 2 is a rear, perspective view of the electrical connector of FIG. 1 showing the opposite side from FIG. 1.

As best seen in FIG. 2, transformer bar 112 further includes an auxiliary conductor bore 142, preferably located at the proximal end 143 of the transformer bar 112, remote from connector body 114. The auxiliary conductor bore 142 receives an auxiliary conductor, typically bore sized for a #2AWG or smaller wire, e.g., one that might be used to power a street light. The auxiliary conductor bore 142 has a corresponding setscrew bore 144 oriented perpendicularly to the auxiliary conductor bore 142. Setscrew bore 144 is internally threaded to receive a screw 146 for retaining the auxiliary conductor in its auxiliary conductor bore 142.

The connector body 114 is fixedly located on the distal end 116 of the transformer bar 112, opposite setscrew bore 144 and auxiliary conductor bore 142. Connector body 114 is defined by first and second bosses 122, 148 on its lower surface for receiving a pin 150, a first connector side 134, a second connector side 136, and a landing pad 152 for providing a positive bolting position of the clamping component 118. The bosses 122, 148 are located towards the front and back of the connector body 114 spaced apart for an attachment link 120 to sit therebetween.

First connector side 134 comprises a first body clamping surface 154 for supporting a larger sized stud. Second connector side 136 comprises a second body clamping surface 156 for supporting a smaller sized stud directly opposite clamping surface 154. The connector body 114 can support more than one sized stud because of the larger radius of curvature on the first body clamping surface 154 and the smaller radius of curvature on the second body clamping surface 156. Each clamping surface has partial threads.

Connector body 114 comprises a circular recess or bore 158 in its upper section walls forming landing pad 152 for receiving a pivot pin. The upper section walls of connector body 114 adjacent to the landing pad 152 include a U-shaped cavity 160 for receiving a clamping member such as a swing bolt 162 with a flange nut 164 threaded thereon. The swing bolt 162 is pivotally coupled to the interior walls of the U-shaped cavity 160 such that it can rotate from one side of the connector body 114 to the other by the pivot pin located in recess 158. To prevent the stud from becoming loose and moving out of its clamped position between the connector body 114 and the clamping component 118, the flange nut 164 is tightened by rotating around the longitudinal axis of the swing bolt 162. The swing bolt 162 pivots through the U-shaped cavity 160, towards either the first connector side 134 or the second connector side 136, depending on which side of the connector body 114 is clamping a stud. The swing bolt 162 could also be pivotally coupled to the clamping component 118. In this position, the clamping component 118 controls the rotational axis of the swing bolt 162 such that the connector body 114 would have a cavity 160 for receiving the bolt 162 as it pivots to aid in clamping a stud.

The clamping component 118 has first and second toggle bosses 166, 168 pivotally coupled to attachment link 120 disposed therebetween. The attachment link 120 is pivotally connected to bosses 122, 148 and bosses 166, 168. The attachment link 120 provides a toggle action that allows the clamping component 118 to pivot around the connector body 114 and clamp a stud on either side of the connector body 114, depending on the size of the stud required, with clamping component 118 substantially parallel to connector body 114 in each of the two clamping positions. Further, the clamping component 118 comprises a U-shaped recess 170 to receive the swing bolt 162 when the clamping component 118 is pivoted from one side of connector body 114 to the other.

Clamping component 118 comprises a first clamping side 172 and a second clamping side 174, having readily accessible component clamping surfaces 176 and 178, respectively. First component clamping surface 176 is located on the first clamping side 172, and a second component clamping surface 178 is located on the second clamping side 174 directly opposite clamping surface 172 such that the longitudinal axes thereof are substantially equally distant from the pivot axis of connector body 114 to attachment link 120. Distances between the clamping surfaces and the pivot axes of the clamping component 118 are equal to those of the connector body 114.

For mating with the first body clamping surface 154 and the second body clamping surface 156, first component clamping surface 176 and second component clamping surface 178 incorporate internally threaded profiles matching clamping surfaces 154 and 156, respectively of particular sizes to promote nesting of the stud between the connector body 114 and the clamping component 118. At least one of the clamping surfaces 176, 178 is threaded. Preferably, first component clamping surface 176 comprises a threaded profile for the larger sized stud, and second component clamping surface 178 comprises a threaded profile for the smaller sized stud. Therefore, first component clamping surface 176 has a greater radius of curvature than second component clamping surface 178. The U-shaped recess 170 is located above the clamping surfaces 176, 178 of the clamping component 118.

The clamping component 118 may be provided with or without thread profiles on the first component clamping surface 176 and on the second component clamping surface 178. When not provided, the first component clamping surface 176 and the second component clamping surface 178 may be comprised of any other type of textured surface which may enhance its suitability for gripping a stud.

Figure 3:
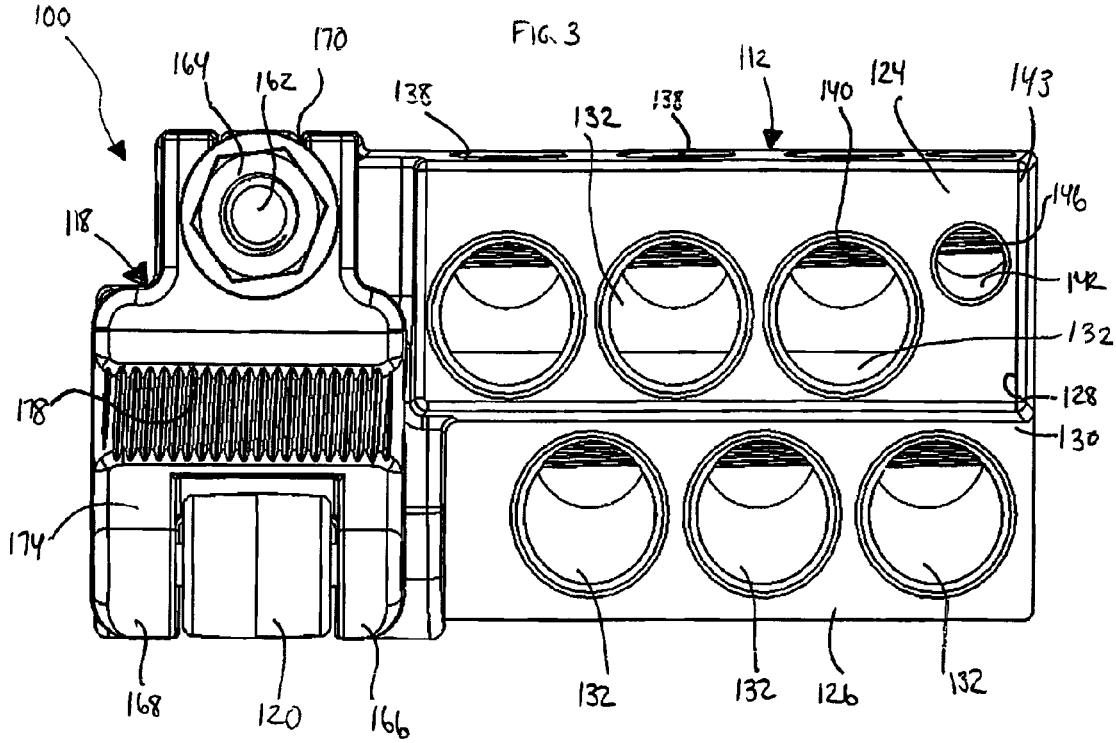
FIG. 3 is a side elevational view of the electrical connector of FIGS. 1 and 2.
Figure 4:
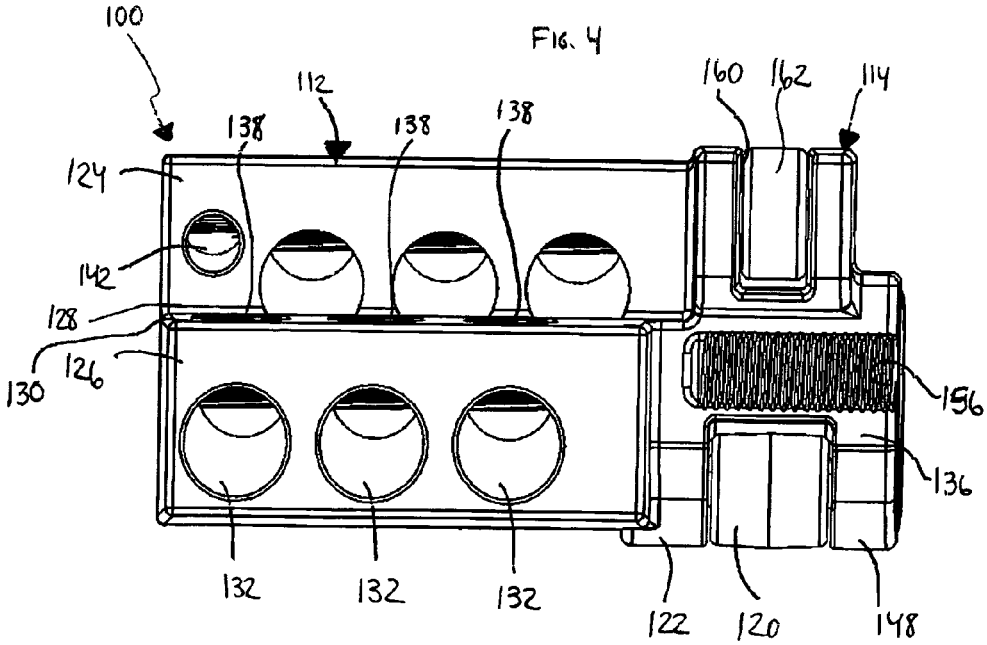
FIG. 4 is a side elevational view of the electrical connector of FIGS. 1-3 showing the opposite side from FIG. 3.

Also seen in FIGS. 3 and 4, attachment link 120 and clamping component 118 are rotated between positions on the first connector side 134 and on the second connector side 136 to align the appropriately matched clamping surfaces. Clamping surfaces that face each other, whether they be first body clamping surface 154 and first component clamping surface 176, or second body clamping surface 156 and second component clamping surface 178, always have substantially the same radii of curvature. This alignment guarantees the equipment or transformer stud will be clamped all around with the correctly fitted thread. It also negates the need for a user or installer to determine any particular orientation as with devices not having captive components, and also prevents the installer from making a mistake.

The attachment link 120 forms a double hinged toggle clamp that connects the clamping component 118 to connector body 114. The purpose of a double hinged toggle is for the attachment link 120 to pivot around the connector body 114 and pivot the clamping component 118 with it. The attachment link 120 and clamping component 118 pivot around the connector body 114 to clamp onto a stud. The size of the stud determines which side of the connector body 114 the clamping component 118 faces.

A landing pad 152, against which the clamping component 118 is tightened, is of particular thickness dimension to limit the travel of the clamping component 118 on each respective side, such that an elastic deflection is achieved in the clamping component 118, resulting in a spring like clamping force of stored mechanical energy. When the clamping component 118 is nested firmly or abuts against the landing pad 152, an electrical interface between connector body 114 and clamping component 118 is created under the tension of the swing bolt 162 to maintain contact at this interface.

Swing bolt 162 with captive flange nut 164 applies the clamping force to secure the electrical connector 100 to the stud. Clamping component 118 constitutes a resilient beam component which flexes within its elastic range. The resilient beam component combined with the elastic strain of the bolt under tension creates a stored energy clamp of the maximum force on either stud size. An appropriately sized boss 122 or landing pad 152 provides enough support of the clamping component 118 on each respective side such that the installer need not be concerned with torque load on the bolt. The installer tightens the flange nut 164 towards the U-shaped recess 170 until the clamping component 118 contacts the landing pad 152, thus preventing the installer from overstressing the resilient beam provision of the clamping component 118. When the flange nut 164 is loosened, bolt 162 is pivoted to disengage clamping component 118 to allow release of the previously clamped stud or to swing around the connector body 114 to clamp another sized stud to the opposite side.

The connector body 114 and the clamping component 118 are threaded to support at least two different, but common sizes of transformer studs. Once the clamping component 118 is rotated adjacent on a face of the connector body 114, it is positioned to be connected to a stud of the appropriate thread size. Following insertion of the stud between the connector body 114 and the clamping component 118, flange nut 164 is tightened, bringing the clamping component 118 into intimate contact with the connector body 114, and elastically deflecting the clamping component 118 over the solid appropriate sized thread transformer 112 bushing stud.

The ability of the electrical connector 100 to accommodate a large or small stud size by merely rotating the clamping component 118 might be necessary where houses or electrical equipment are built in an area that is served by one transformer, but the load grows to require a larger transformer. The existing main conductors could remain attached, essentially undisturbed, while only the swing bolt and toggle clamp are loosened, the old smaller transformer removed, and the new larger unit installed in its place. The connectors would simply be reconfigured to accommodate the larger studs of the new transformer.

According to the above embodiments, an electrical connector may be coupled with a setscrew type transformer bar as in the accompanying figures, or it could be an integral part of other types of connectors utilized with a threaded stud, such as a paddle type to which a plurality of lugs might be attached. An electrical connector, as described and illustrated above, could also be utilized with a single cable connection, a tubular buss type connection, or any of several other styles of conductors which may be connected to a transformer stud.

While the invention as illustrated is contemplated to be manufactured of aluminum, or an alloy thereof, it will be appreciated that the same device could be made of copper, or an alloy thereof, or some other conductive material if the application is to require an electrical interface. However, certain relative dimensions and proportions as depicted in the accompanying illustrations might be changed to create the optimum elastic deflection in the attachment link component.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

a transformer bar having a plurality of conductor bores therein, a distal end, an upper component having at least one setscrew extendable into one of said bores with wrenching on an exposed end thereof, and a lower component with a lower end surface remote from said exposed end of said setscrew;

a connector body at said distal end having at least one boss adjacent said lower surface of said lower component and having first and second connector sides; and a clamping component pivotally mounted by an attachment link to said boss to be selectively located adjacent each of said first and second connector sides.

2. An electrical connector according to claim 1 wherein said transformer bar is substantially Z-shaped.

3. An electrical connector according to claim 1 wherein said connector body includes first and second bosses adjacent said lower component and one of said bosses is located adjacent a the distal end of said connector.

4. An electrical connector according to claim 3 wherein said attachment link is pivotally mounted to said bosses, said bosses located towards said distal end.

5. An electrical connector according to claim 1 wherein a clamping member is securable to said clamping component and said connector body to force said clamping component and said connector body toward one another.

6. An electrical connector according to claim 1 wherein said connector body comprises first and second concavely curved body clamping surfaces on said first and second connector sides, respectively, said first body clamping surface having a greater radius of curvature than said second body clamping surface; and said clamping component comprises first and second concavely curved component clamping surfaces on first and second component sides thereof, said first component clamping surface having a greater radius of curvature than said second component clamping surface.

7. An electrical connector according to claim 1 wherein the plurality of conductor bores of said transformer bar are arranged in at least two offset rows.

8. An electrical connector according to claim 7 wherein said transformer bar comprises a plurality of setscrew bores arranged in a row above the conductor bores and substantially oriented perpendicularly to the conductor bores.

9. An electrical connector according to claim 8 wherein said transformer bar comprises at least one bore at the end of one of said rows that is an auxiliary conductor bore.

10. An electrical connector according to claim 9 wherein at least one bore is perpendicular to said auxiliary conductor bore.

11. An electrical connector according to claim 3 wherein said clamping component is a toggle clamp with first and second toggle bosses on a top thereof.

12. An electrical connector according to claim 6 wherein at least one of said clamping surfaces is threaded.

13. An electrical connector according to claim 1 wherein one of said connector body and said clamping component has a bolt pivotally coupled thereto; and the other of said connector body and said clamping component has a U-shaped recess for receiving said bolt.

14. An electrical connector according to claim 13 wherein said bolt pivots about an axis perpendicular to a longitudinal axis thereof from a first side of one of said connector body and said clamping component to a second side of the same of said connector body and said clamping component; and a flange nut is threadedly received on said bolt for securing said bolt to the second side.

15. An electrical connector according to claim 14 wherein said bolt is pivotally coupled to said connector body; and said U-shaped recess is on said clamping component.

16. An electrical connector according to claim 1 wherein said connector body comprises first and second concavely curved body clamping surfaces on said first and second connector sides, respectively, said first body clamping surface having a greater radius of curvature than said second body clamping surface.

17. An electrical connector according to claim 1 wherein said clamping component comprises first and second concavely curved component clamping surfaces on first and second componentsides thereof, said first component clamping surface having a greater radius of curvature than said second component clamping surface.

18. An electrical connector, comprising:

a transformer bar having a plurality of conductor bores therein, a distal end for supporting a connector body, an upper component with at least one setscrew extendable into one of said bores with wrenching on an exposed end thereof, and a lower component with a lower end surface remote from the exposed end of the setscrew and offset from said upper component in a substantially Z-shaped configuration to receive a plurality of branch circuit wires, said upper and lower components having a plurality of bores receiving a plurality of screws to retain the branch circuit wires;

a connector body at said distal end having first and second bosses adjacent said lower component opposite said upper and lower components having first and second connector sides, said connector body having first and second concavely curved body clamping surfaces on said first and second connector sides, respectively, said first body clamping surface having a greater radius of curvature than said second body clamping surface; and a clamping component pivotally mounted by an attachment link to said first and second bosses to be selectively located adjacent one of said first and second connector sides, said clamping component having first and second concavely curved component clamping surfaces on first and second sides thereof respectively, said first component clamping surface having a greater radius of curvature than said second component clamping surface, said first clamping surfaces have substantially equal radii of curvature and said second clamping surfaces have another substantially equal radii of curvature smaller than the radii of curvature of said first clamping surfaces;

a bolt pivotally coupled to one of said connector body and said clamping component to force said clamping component and said connector body toward one another, the other of said connector body and said clamping component having a U-shaped recess for receiving said bolt; and a flange nut threaded on said bolt for securing said connector body and said clamping component together.

19. An electrical connector according to claim 18 wherein said transformer bar comprises a plurality of setscrew bores arranged in a row above the conductor bores and substantially oriented perpendicular to the conductor bores;

at least one bore at the end of one of said rows is an auxiliary conductor bore; and at least one bore is perpendicular to said auxiliary conductor bore.

20. An electrical connector, comprising:

a transformer bar having a plurality of conductor bores therein, a distal end, an upper component, and a lower component offset from said upper component such that a lower corner of said upper component is coupled to an upper corner of said bottom component;

a connector body at said distal end having a boss at said lower component having first and second connector sides;

a clamping component pivotally mounted by an attachment link to said boss to be selectively located adjacent each of said first and second connector sides; and a uniformly sized stud adjacent a clamping component for accommodating attachment to one of a first and second side of said bar.

* * * * *